US008720628B2

(12) United States Patent
Fuchibe

(10) Patent No.: US 8,720,628 B2
(45) Date of Patent: May 13, 2014

(54) WORKING MACHINE WITH EQUIPMENT ROOM

(75) Inventor: Ryoichi Fuchibe, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 495 days.

(21) Appl. No.: 13/044,907

(22) Filed: Mar. 10, 2011

(65) Prior Publication Data

US 2011/0243700 A1 Oct. 6, 2011

(30) Foreign Application Priority Data

Mar. 31, 2010 (JP) ..... 2010-082374

(51) Int. Cl.
*E02F 3/36* (2006.01)

(52) U.S. Cl.
USPC ..... 180/69.2; 180/69.21; 180/89.13; 180/89.17; 296/190.08; 296/190.11

(58) Field of Classification Search
None
See application file for complete search history.

(56) References Cited

U.S. PATENT DOCUMENTS 3,802,022 A * 4/1974 Fleming ..... 15/84
4,359,121 A * 11/1982 Messner et al. ..... 180/69.21
4,506,750 A * 3/1985 Leskovec ..... 180/69.21
4,616,872 A * 10/1986 Akira et al. ..... 296/190.11
4,889,203 A * 12/1989 Hagarty ..... 180/69.24
5,303,792 A * 4/1994 Shimizu ..... 180/89.17
5,370,847 A * 12/1994 Lee ..... 423/210
5,671,820 A * 9/1997 Kobayashi et al. ..... 180/68.1
5,715,615 A * 2/1998 Murakami et al. ..... 37/379
5,810,423 A * 9/1998 Brackmann et al. ..... 296/146.2
5,826,440 A * 10/1998 Okada et al. ..... 62/239
6,017,083 A * 1/2000 Edgeller ..... 296/185.1
6,058,903 A * 5/2000 Downham ..... 123/198 E (Continued)

FOREIGN PATENT DOCUMENTS

EP 1 493 870 A1 1/2005
JP 2005-23727 1/2005

OTHER PUBLICATIONS

Extended European Search Report issued on Sep. 20, 2011 in the corresponding European Application No. 11158970.1.

*Primary Examiner* — J. Allen Shriver, II
*Assistant Examiner* — Hilary L Johns
(74) *Attorney, Agent, or Firm* — Oblon, Spivak, McClelland, Maier & Neustadt, L.L.P.

(57) ABSTRACT

A working machine comprising a frame, a working implement supported at a front end of the frame, a cover member, a latch member, a selector valve and a support bracket. The cover member has a cover-member body covering a side equipment room and having an opening. The latch member is disposed near the opening and inside the side equipment room to hold the cover member closed in cooperation with the lockable member. The support bracket extends from the side equipment room toward the opening and supports the latch member and the selector valve at the side of the frame. The support bracket has a base portion connected to the frame or connected to another member fixed to the frame, a selector valve-retaining portion retaining the selector valve and a latch member-retaining portion retaining the latch member at a position closer to the opening and higher than the selector valve.

7 Claims, 12 Drawing Sheets

(56) References Cited

U.S. PATENT DOCUMENTS

| | | | | |
|---|---|---|---|---|
| 6,135,223 | A * | 10/2000 | Miyachi et al. | 180/69.21 |
| 6,194,997 | B1 * | 2/2001 | Buchner et al. | 340/426.26 |
| 6,213,235 | B1 * | 4/2001 | Elhardt et al. | 180/69.2 |
| 6,471,837 | B1 * | 10/2002 | Hans et al. | 204/298.41 |
| 6,626,256 | B2 * | 9/2003 | Dennison et al. | 180/69.24 |
| 6,634,449 | B2 * | 10/2003 | Randolph | 180/69.24 |
| 7,134,519 | B2 * | 11/2006 | Imashige | 180/69.24 |
| 2004/0238247 | A1 * | 12/2004 | Ohashi et al. | 180/69.2 |
| 2005/0000746 | A1 * | 1/2005 | Imashige | 180/69.24 |
| 2008/0078564 | A1 | 4/2008 | Muramoto et al. | |

* cited by examiner

WORKING MACHINE WITH EQUIPMENT ROOM

BACKGROUND OF THE INVENTION

1. Field of the Invention

The present invention relates to a working machine, such as a hydraulic shovel (excavator), having an equipment room and a cover member for covering the equipment room.

2. Description of the Background Art

Heretofore, as a construction machine having an equipment room, there has been known one type described in JP 2005-23727 A. This working machine comprises a relatively large guard cover for covering hydraulic equipment. The guard cover is formed with a small window and provided with a small-window cover for selectively opening and closing the small window. The small-window cover is adapted to be strictly lockable by a keylock.

The working machine further comprises a locking mechanism adapted to lock the guard cover in a closed state. The locking mechanism is disposed inward of the small window. This makes it necessary to open the small window and then release a lock function of the locking mechanism, for an opening operation of the guard cover. This allows the locking mechanism to have no complicated structure, such as a keylock, resulting in an improvement in aesthetic appearance and safety and a reduction in cost of the construction machine.

Meanwhile, working machines include a type having a small turning radius, i.e., an ability to turn in a small radius (small turning type). The small radius of the small turning type restricts an equipment installation space. Consequently, this type of working machine has only a small equipment room, in which there are disposed devices such as a control valve or components connected to the devices such as various valves and pipes or hoses, in closely-spaced relation within the narrow space.

The valves include a specific selector valve which is required to be protected from external shock or the like. In view of the protection, a large distance is preferably given between the selector valve and the guard cover, which reduces a possibility of the shock given to the selector valve when a rock or the like hits against the guard cover so as to deform the guard cover. On the other hand, giving a large distance between the selector valve and the guard cover involves a difficulty of the manual operation of the selector valve from outside of the guard cover.

The problem will be explained more specifically below, with reference to a small turning-type hydraulic shovel 100 shown in FIG. 9 as a reference example.

The hydraulic shovel 100 comprises a lower propelling body 101 (in FIG. 9, a crawler type), and an upper slewing body 102 mounted on the lower propelling body 101. The upper slewing body 102 is equipped with a frame 103 (base frame), an attachment 104, a cab 105, a side cover (guard cover) 107 covering a side equipment room 106, etc. The side equipment room 106 receives therein a hydraulic fluid tank 110, a control valve 111, etc.

As shown in FIGS. 10 to 12, the side cover 107 has a cover body 108 and a small-window cover 112. The cover body 108 has a rear end supported on the side of the frame 103 pivotably about a vertical axis so as to largely and laterally open/close. The cover body 108 has a front end portion formed with an opening 107*a*, and the small-window cover 112 is attached to the cover body 108 to selectively open and close the opening 107*a*. The small-window cover 112 is provided with a keylock unit 113 which can be operated by a given key. Inside the side equipment room 106, there is provided a latch member 114, which is adapted to hold the side cover 107 in a closed state and allow a person such as an operator to manually release the holding of the closed state by a simple operation. This means that opening the side cover 107 requires opening the small-window cover 112 and then manually operating the latch member 114 to release the holding of the closed state.

As shown in FIG. 11, the control valve 111 is disposed on a right side of and adjacent to the hydraulic fluid tank 110, extending in an frontward-rearward direction of the hydraulic shovel. The control valve 111 is connected to a large number of pipes (hoses), which are densely provided around the control valve 111; FIG. 11, however, shows only a part of the pipes 111*a*.

The hydraulic fluid tank 110 has a front surface, to which a selector-valve bracket 115 is attached. To the selector-valve bracket 115, there is mounted a selector valve 116 adapted to be manually operated to change a flow of hydraulic fluid.

The hydraulic fluid tank 110 has a side surface, onto which a latch bracket 117 is attached. The latch bracket 117 has a generally L shape, having a long strip-shaped arm portion 117*a* including one end, which is attached to the hydraulic fluid tank 110, and a short latch support portion 117*b* extending continuously and bendedly from the other end of the arm portion 117*a*. The latch member 114 is provided on the latch support portion 117*b*.

As shown in FIG. 12, the latch member 114 is provided in the middle of an upper region in the opening 107*a* viewed from a front side thereof, so as to be easily operated. Inside the side cover 107, there is attached a lockable member 118 to the side cover 107; the lockable member 118 is latched by the latch member 114, thus holding the side cover 107 in the closed state. The opening 107*a* is used not only for the manual operation for the latch member 114 but also for maintenance to be relatively frequently performed, such as the manual operation for the selector valve 116.

In the hydraulic shovel 100, there may be dropped off a rock or the like which has been scooped up during working to thereby hit against the side cover 107. Particularly, the front end of the side cover 107, facing a working area, is likely to be hit. The side cover 107, if largely deformed by the hitting, might transmit the shock due to the hitting to the selector valve 116 through the side cover 107. In view of this, the selector valve 116 is required to be located inwardly far away from the side cover 107 so as to be free from the shock even in the above-mentioned accident. However, the thus located selector valve 116 cannot be easily operated from outside.

SUMMARY OF THE INVENTION

It is an object of the present invention to provide a working machine, which comprises a cover member for covering an equipment room and a selector valve provided inside the equipment room, having a capability to effectively protect the selector valve even if the cover member is hit by a rock or the like, while allowing the selector valve to be easily operated from outside of the cover member.

Specifically, provided is a working machine which comprises: a frame; a working implement supported at a front end of the frame in a vertically swingable manner; a cover member which has a cover-member body adapted to cover a side equipment room located on the frame in laterally adjacent relation to the working implement, from at least front and lateral sides thereof, the cover-member body being formed with an opening, a lid member attached to the cover-member body to selectively open and close the opening, a lockable member attached to an inner side of the cover-member body at a position adjacent to the opening, and a hinge portion which interconnects between the frame and a rear end of the cover-member body and supports the cover-member body in an openable/closable manner; a latch member disposed inside the side equipment room and adjacent to the opening and adapted to hold the cover member in a closed state in cooperation with the lockable member; a selector valve disposed adjacent to the opening and adapted to be manually operable; and a support bracket which extends from an inward side of the side equipment room toward the opening and supports the latch member and the selector valve on a side of the frame. The support bracket has a selector valve-retaining portion which supports the selector valve, and a latch member-retaining portion which retains the latch member at a position closer to the opening than the selector valve and higher than the selector valve.

It should be noted that the present invention includes not only an embodiment where the support bracket which "supports the latch member and the selector valve on the side of the frame" is directly connected to the frame, but also an embodiment where the support bracket is connected to another member fixed to the frame so as to be indirectly connected to the frame through the member.

DESCRIPTION OF THE PREFERRED EMBODIMENTS

With reference to the drawings, the present invention will be specifically described based on one embodiment thereof. It should be noted that the following description is an illustration and not intended to limit the present invention and a target working machine or application thereof.

Figure 1:
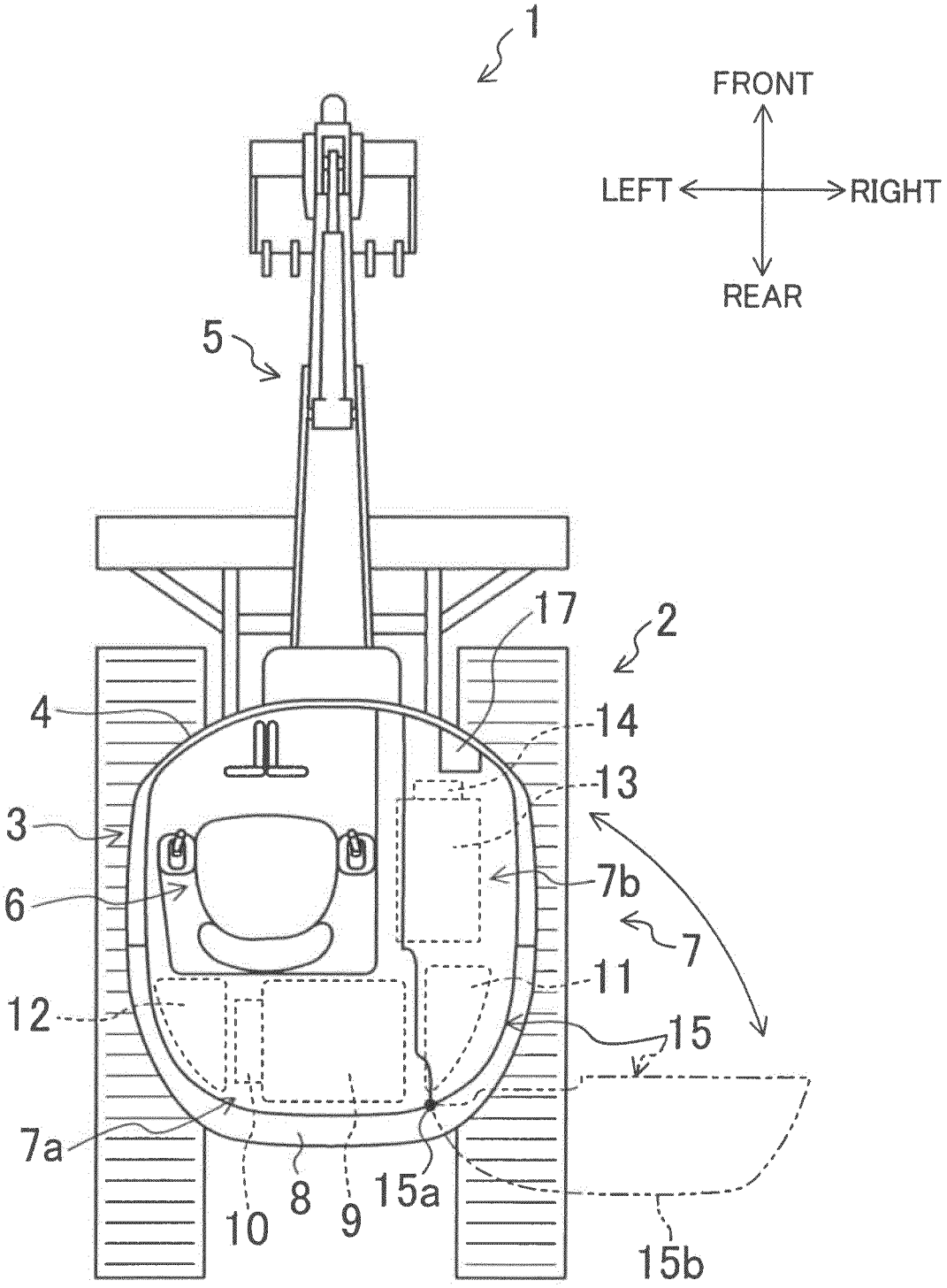
FIG. 1 is a top plan view of a hydraulic shovel according to one embodiment of the present invention.

FIG. 1 shows a small turning-type hydraulic shovel 1 which is a working machine according to one embodiment of the present invention. The hydraulic shovel 1 has a fundamental structure equal to that of the above-mentioned hydraulic shovel 100 as a reference example. Specifically, the hydraulic shovel 1 comprises a crawler-type lower propelling body 2, an upper slewing body 3 mounted on the lower propelling body 2, the upper slewing body 3 equipped with a frame 4, an attachment 5, a cab 6, a side cover 15 adapted to cover an equipment room 7, a counterweight 8, etc.

The frame 4 in this embodiment has a disk-like external shape in top plan view, and the lower propelling body 2 slewably supports an approximately central portion of the frame 4. The frame 4 extends horizontally and supports the cab 6 and the equipment room 7 thereon.

The attachment 5 comprises a boom, an arm, and a bucket, supported, in the illustrated type, by an approximately center portion of a front end of the frame 4 in a swingable manner in a vertical direction and a rightward-leftward (lateral) direction. The counterweight 8 is disposed on a rear region of the upper slewing body 3 so as to keep a balance, in a frontward-rearward direction, with the attachment 5. In this small turning type having only a restricted installation space, the counterweight 8 is designed to serve as also a cover which covers a lower region of the equipment room 7.

The cab 6, which comprises a cab seat, an operating device and a canopy, is disposed on a left side of a front region of the upper slewing body 3.

The equipment room 7 is disposed in an area, around the cab 6, from the rear region to a right region of the upper slewing body 3, comprised of a rear equipment room **7*a* and a side equipment room (a right side equipment room in this embodiment) 7*b*. The rear equipment room 7*a* receives therein an engine 9, a hydraulic pump 10, a radiator 11, a fuel tank 12, etc., while the side equipment room 7*b* receives therein a hydraulic fluid tank 13, a control valve 14, etc. The side equipment room 7*b* has a front region located on a right side of and adjacent to the attachment 5**.

The rear equipment room **7*a* is covered primarily by a rear cover from upper and lateral sides thereof, and the side equipment room 7*b* is covered primarily by a side cover 15, which is equivalent to "cover member" set forth in the appended claims, from upper and lateral sides thereof. The side cover 15 has: a cover body 15*b* which is equivalent to "cover-member body" set forth in the appended claims; a hinge portion 15*a* which supports the cover body 15*b* on the side of the frame 4 so as to allow the cover body 15*b* to swing about a vertical pivot; and a lid member 17**.

The cover body **15*b* is moved between a closed position and an open position by the above swing movement about the vertical pivot, and has a shape capable of covering the side equipment room 7*b* from the front and lateral sides thereof, in the closed position, whereby it can be largely opened rightwardly from the closed position about the hinge portion 15*a* as a support point, as indicated by the two-dot chain line in FIG. 1. The cover body 15*b* has a front end portion formed with an opening 16, as shown in FIG. 2, and the lid member 17 is attached to the cover body 15*b* in a swingable manner about a vertical pivot to selectively open and close the opening 16**.

Figure 2:
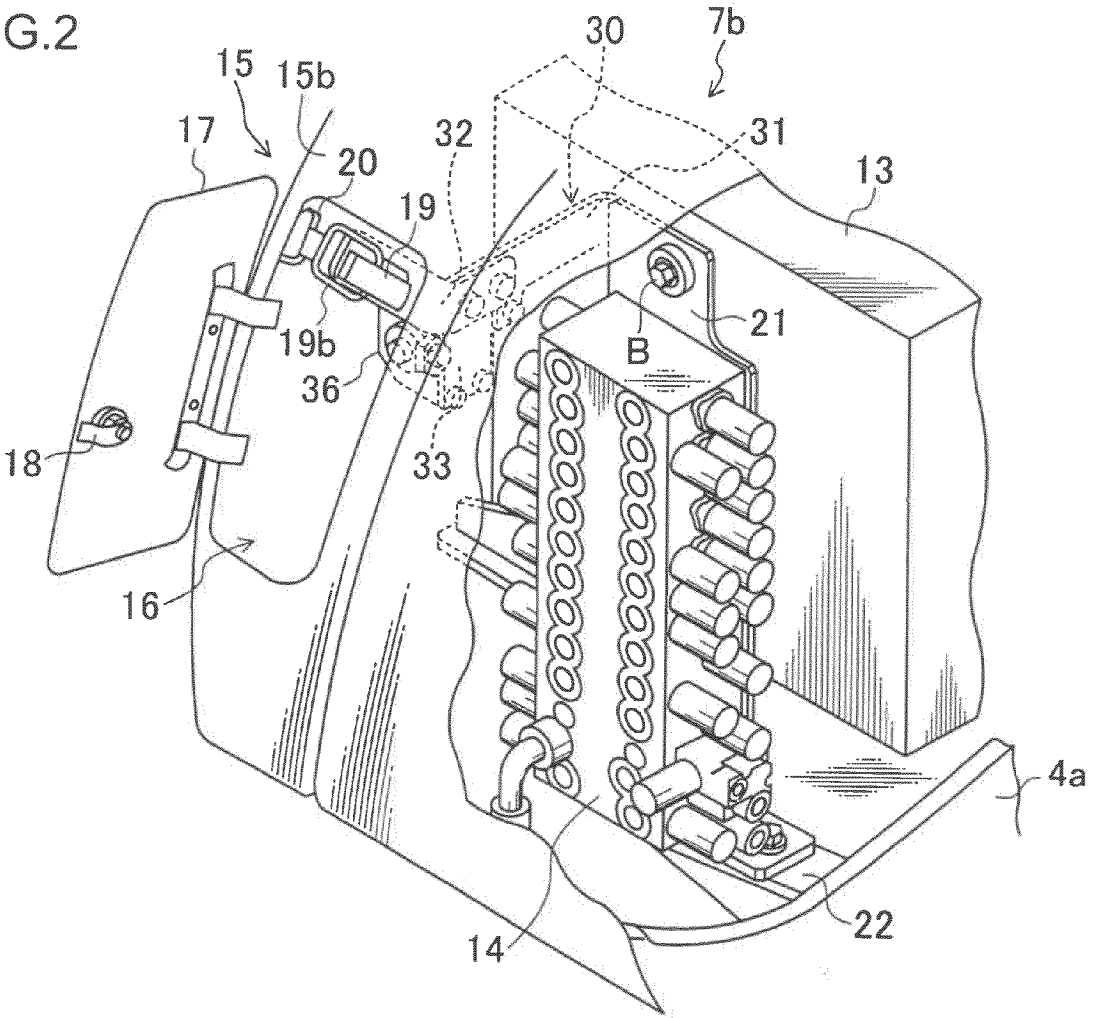
FIG. 2 is a perspective view showing an inside of a front region of a side equipment room of the hydraulic shovel.
Figure 3:
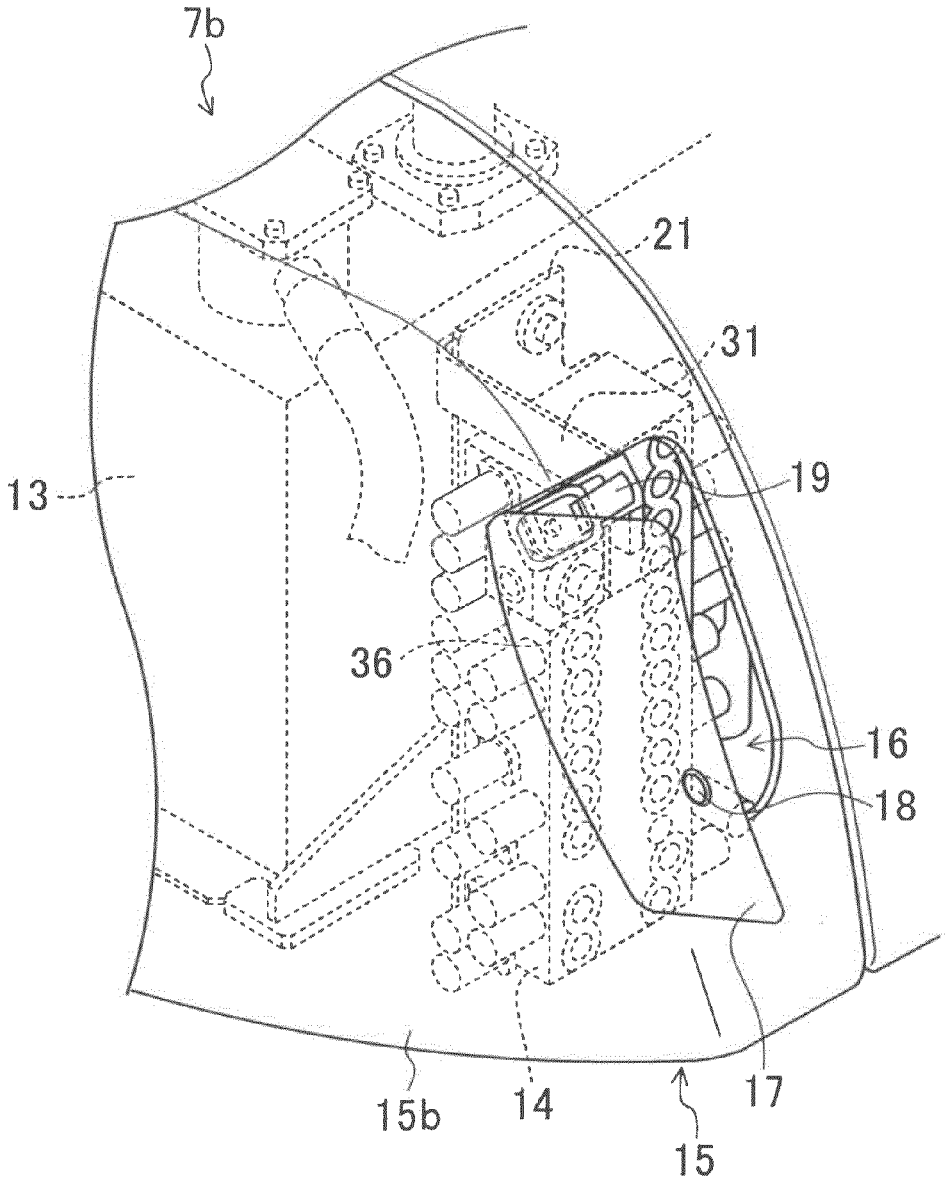
FIG. 3 is a perspective view showing an apparatus of the side equipment room with an opening at a front of the side equipment room opened.
Figure 4:
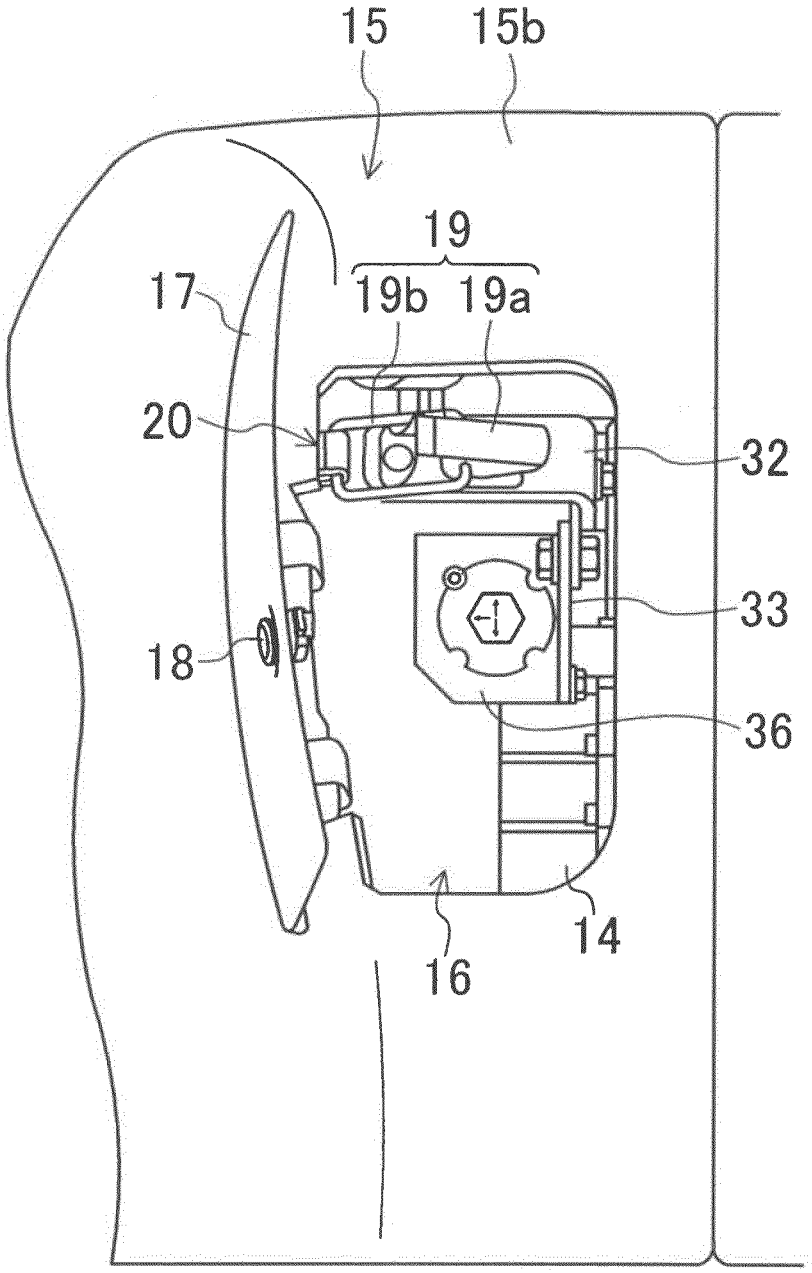
FIG. 4 is a front view of the opening opened as shown in FIG. 3.
Figure 5:
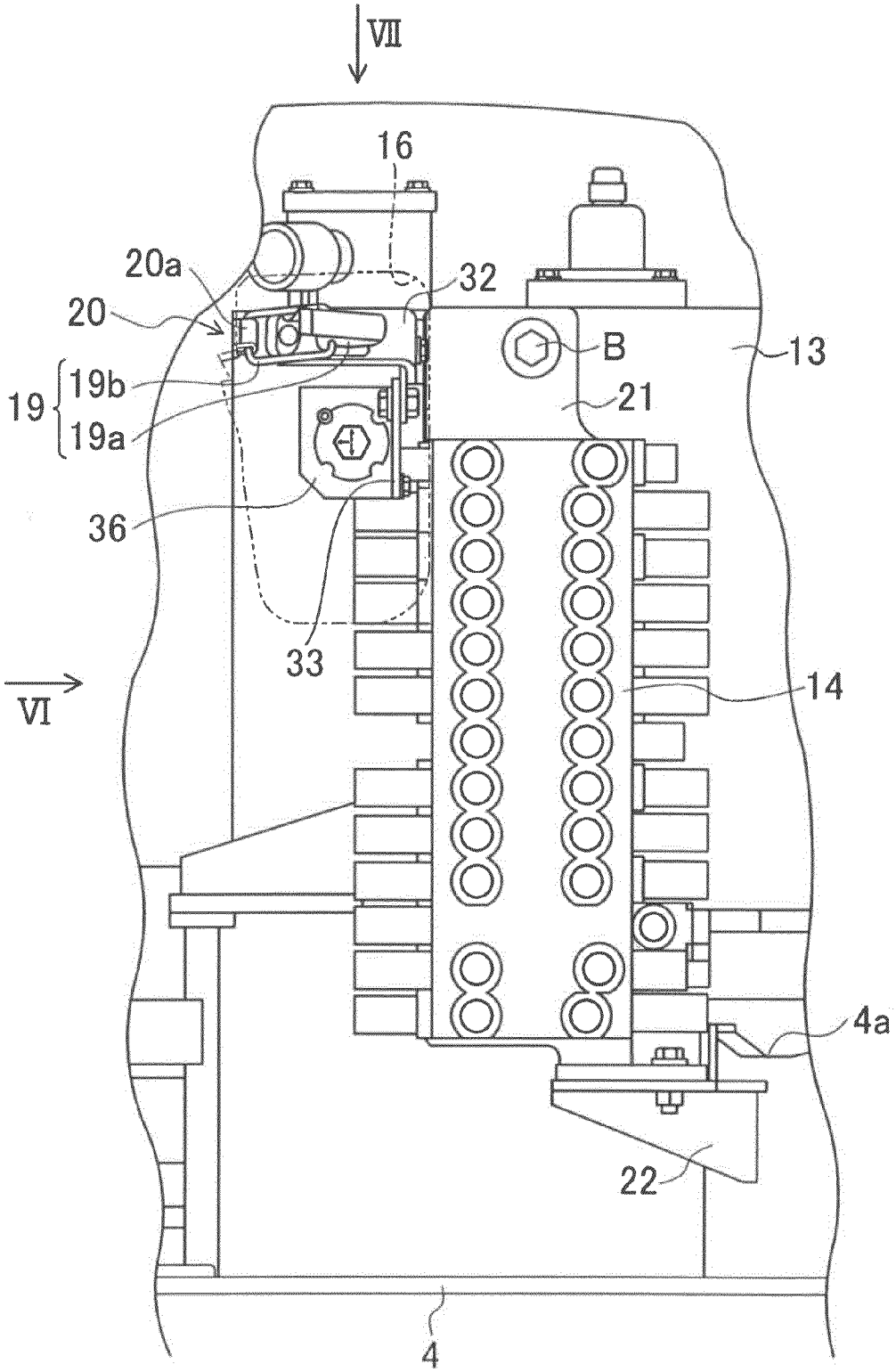
FIG. 5 is a front view showing the inside of the side equipment room.
Figure 6:
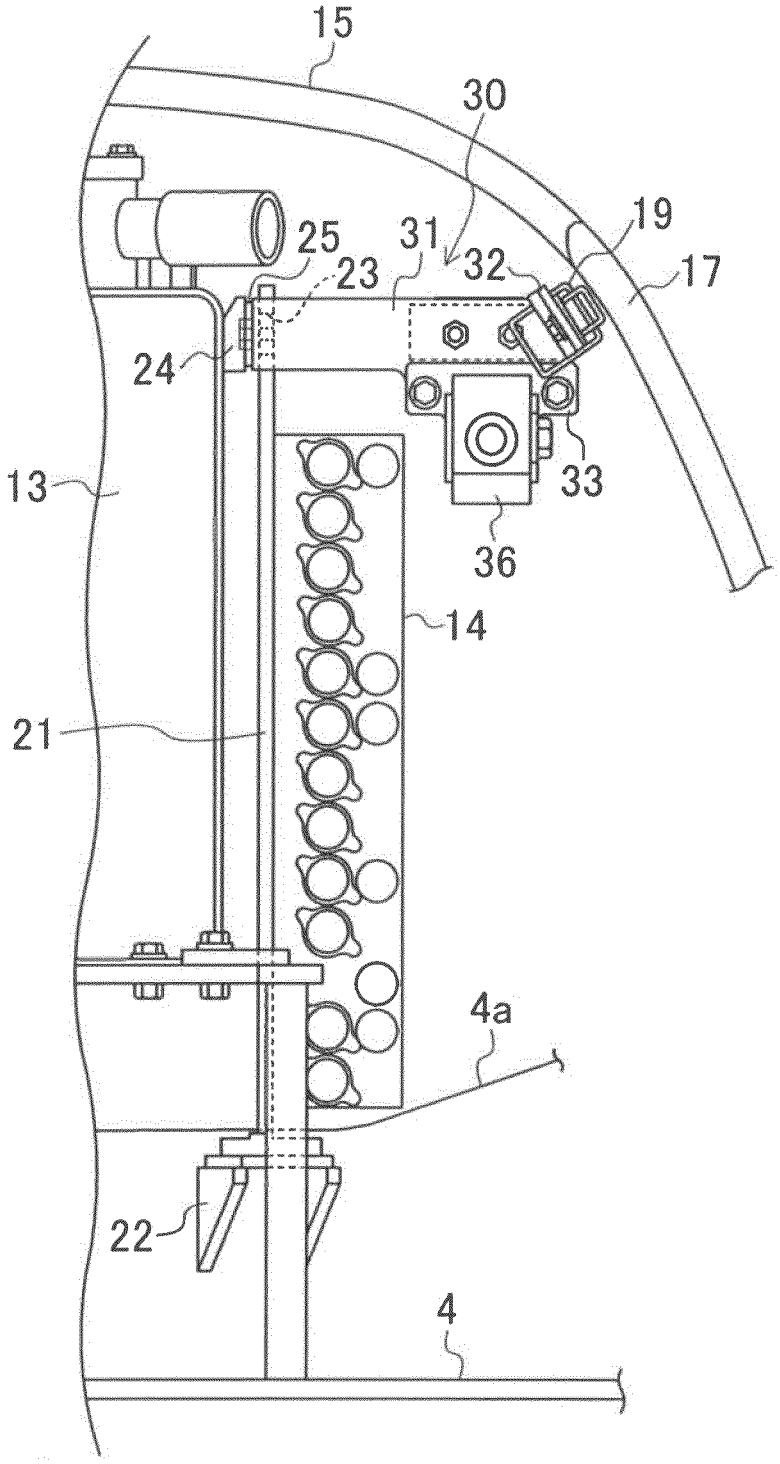
FIG. 6 illustrates the inside of the side equipment room viewed in a direction indicated by the arrowed line VI in FIG. 5.
Figure 7:
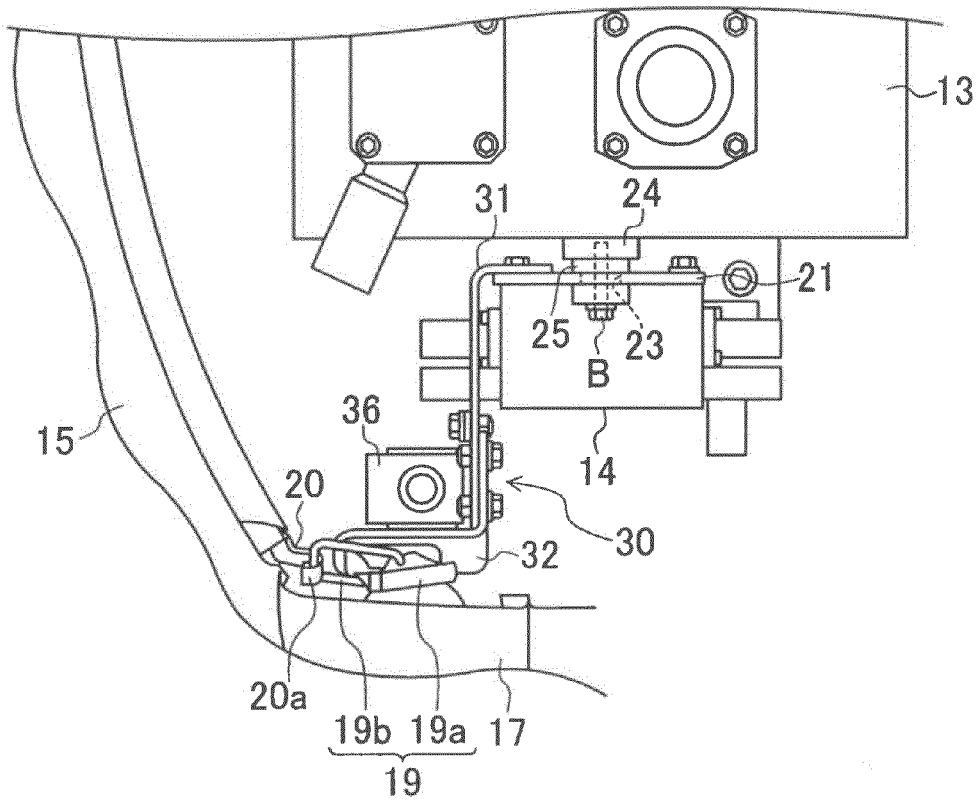
FIG. 7 illustrates the inside of the side equipment room viewed in a direction indicated by the arrowed line VII in FIG. 5.

FIGS. 2 to 7 show the lateral equipment chamber **7*b*, particularly, a structure in a front region thereof. FIG. 2 and FIG. 3 are perspective views of the front region of the lateral equipment chamber 7*b*, when viewed from an outside thereof; FIG. 2 includes partially cutting off a part of the cover to show an inside of the lateral equipment chamber 7*b*. FIG. 4 is a front view showing a state where the lid member 17 has been opened, and FIG. 5 illustrates the inside of the side equipment room 7*b* viewed from a front side thereof. FIG. 6 illustrates the inside of the side equipment room 7*b* viewed from a direction indicated by the arrowed line VI in FIG. 5, and FIG. 7 illustrates the inside of the side equipment room 7*b*, when views from a direction indicated by the arrowed line VII in FIG. 5**.

As shown in FIGS. 2 and 3, the lid member 17 has a basal end supported by the cover body 15*b* in a swingable manner about the vertical pivot and a free end on the side opposite to the basal end, the swing movement allowing the lid member 17 to be switched between an open position to open the opening 16 and a close position to close the opening 16. The lid member 17 is provided with a keylock unit 18 for locking the lid member 17 at the close position. There is attached a lockable member 20 to an inner surface of the cover body 15*b*, at a position adjacent to an upper end of the opening 16 (the position is on a left side of the opening 16 in FIGS. 2 to 4). The lockable member 20 is designed to hold the side cover 15 in a closed state in cooperation with an after-mentioned latch member 19, having a distal end protruding into the opening 16 beyond a left peripheral edge of the opening 16; the distal end is formed with a J-shaped hook 20*a* (see FIG. 7).

The hydraulic fluid tank 13 and the control valve 14 are provided on a front side of the side equipment room 7*b*. The hydraulic fluid tank 13, which is a pressure vessel for storing hydraulic fluid therein, has a generally rectangular parallelepiped shape, in this embodiment. The control valve 14, which is a device for hydraulically controlling the attachment 5 and others based on the hydraulic fluid, is disposed frontward of the hydraulic fluid tank 13. Also FIG. 7, etc, shows only a part of the pipes.

As shown in FIGS. 5 and 6, the control valve 14 in this embodiment is vertically installed so as to extend in a vertical direction and supported by the frame 4 and the hydraulic fluid tank 13 through a base 21. The base 21, which is a flat plate-like structural member vertically extending and having an upper end and a lower end, is disposed so as to extend along a certain surface, which is a surface facing the opening 16, a front surface in this embodiment, of side surfaces of the hydraulic fluid tank 13. The upper end of the base 21 is located adjacent to the opening 16, while the lower end of the base 21 is fixed to a vertical plate 4*a* standing on the frame 4 upright, through a beam member 22. In other words, the base 21 is so provided as to stand on the frame 4.

Between the upper end of the base 21 and the hydraulic fluid tank 13, there is provided a shock-absorbing member 25 as shown in FIGS. 6 and 7. In detail, the upper end of the base 21 is formed with a through-hole 23 and, corresponding to the through-hole 23, the front end of the hydraulic fluid tank 13 is provided with a fastening boss 24 into which a bolt B can be screwed. The bolt B, having an outer diameter less than an inner diameter of the through-hole 23, is inserted into the through-hole 23 and screwed into the fastening boss 24, while clamping the shock-absorbing member 25 between the fastening boss 24 and the base 21. The shock-absorbing member 25, in the clamped state, is operable to absorb vibration and shock applied to the base 21 to suppress a transmission of the vibration and shock to the hydraulic fluid tank 13, in spite of the support of the base 21 by the hydraulic fluid tank 13.

Figure 8:
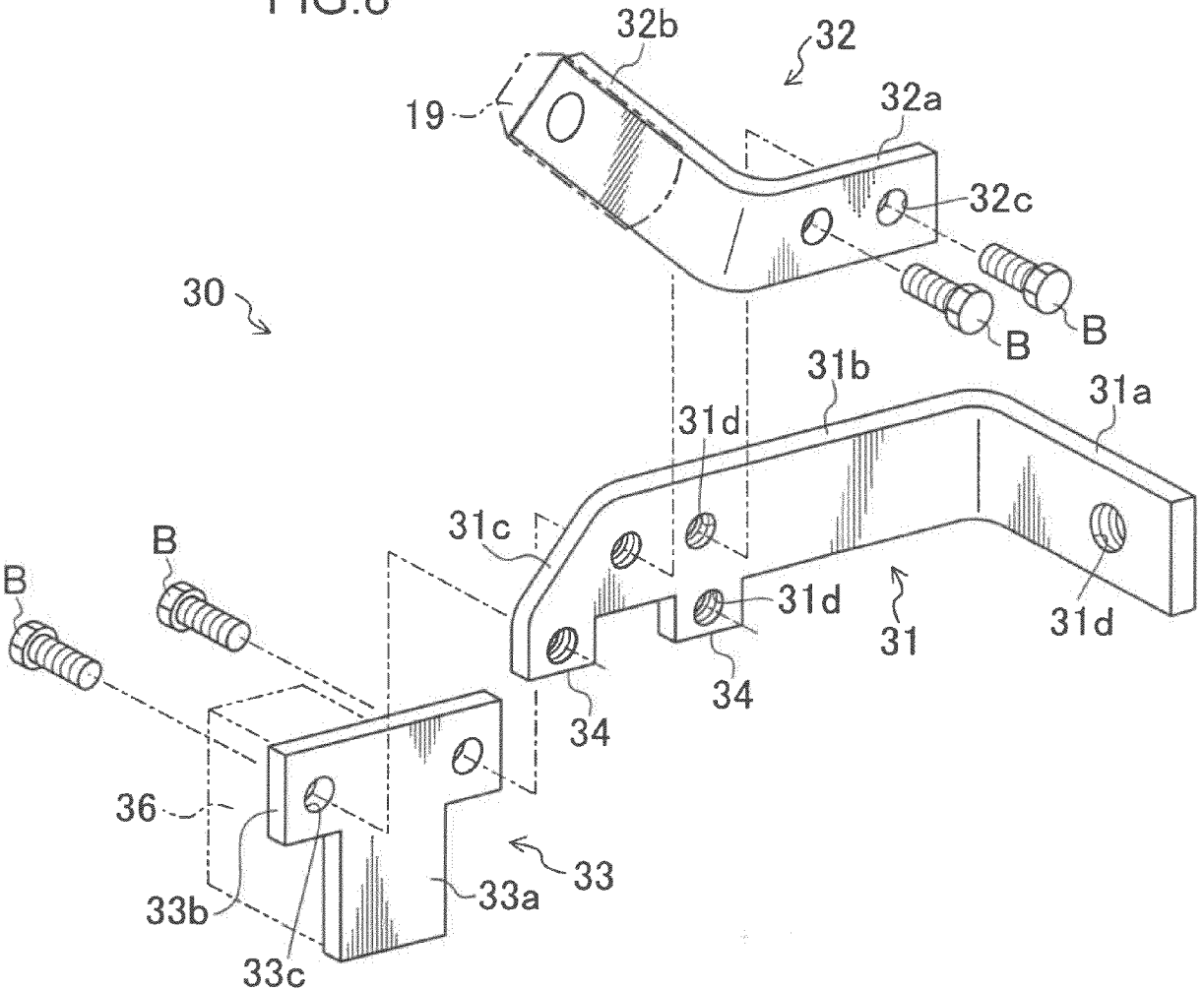
FIG. 8 is an exploded perspective view of a support bracket provided inside the side equipment room.
Figure 9:
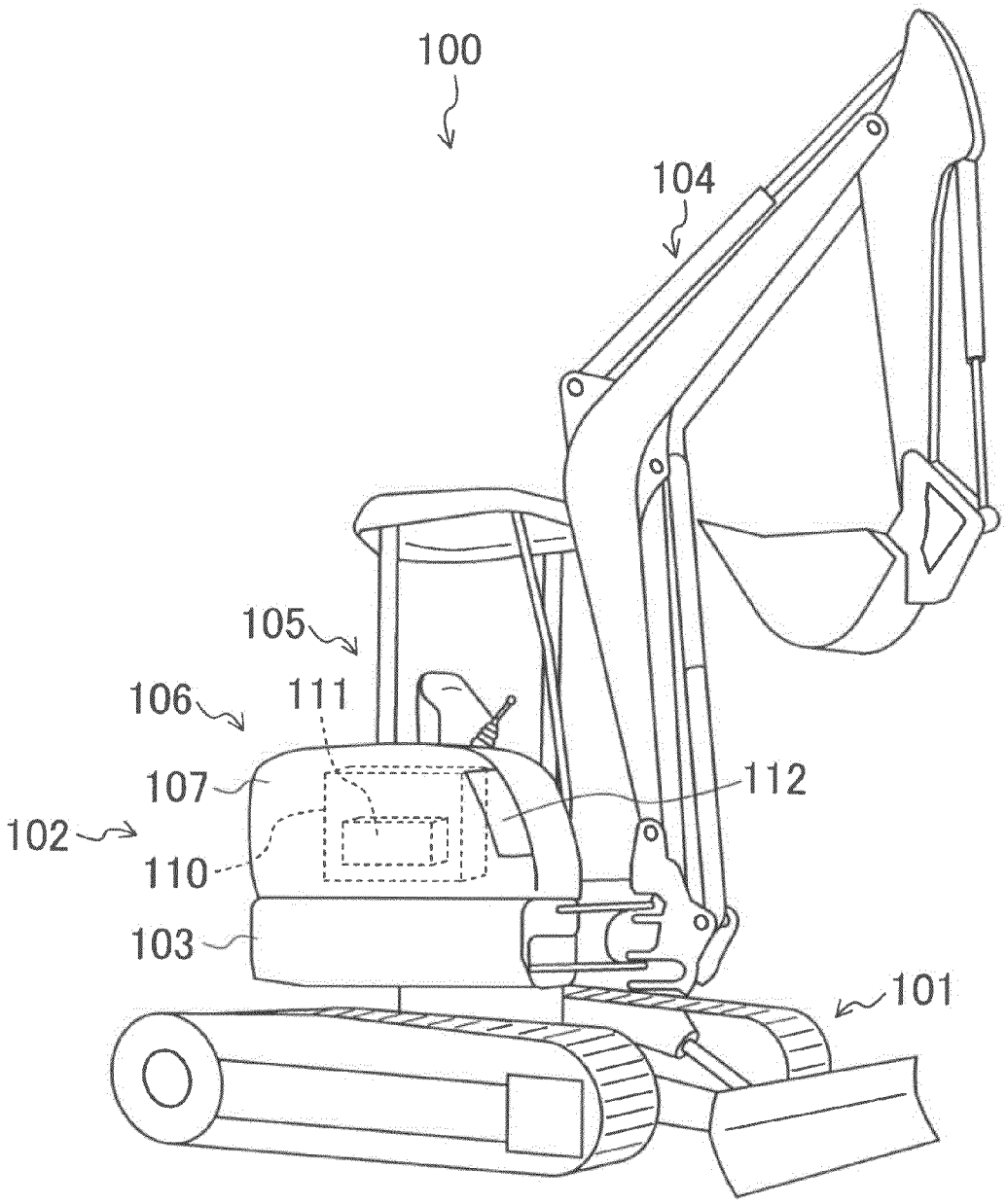
FIG. 9 is a schematic perspective view showing one example of a small turning-type hydraulic shovel.

The working machine according to this embodiment further comprises a support bracket 30 as shown in FIG. 8. The support bracket 30, which is a member to support the after-mentioned latch member 19 and an after-mentioned selector valve 36 on the side of the frame 4, is attached to the upper end of the base 21, having a shape of extending from the upper end toward the lid member 17 and the opening 16. The support bracket 30 primarily comprises a bracket body 31, a first bracket 32, which is equivalent to "latch member-retaining bracket" set forth in the appended claims, and a second bracket 33, which is equivalent to "selector valve-retaining bracket" set forth in the appended claims.

The bracket body 31 is a strip-shaped metal member bent into a generally L shape, having a base portion 31*a* to be fixed to the base 21 and an arm portion 31*b* extending from the base portion 31*a* in a direction perpendicular to the base portion 31*a*. The arm portion 31*b* has a distal end oriented toward the opening 16 and the distal end is formed with an inclined region 31*c*. The inclined region 31*c* has an end edge which is so inclined that one of opposite side ends thereof, which is a lower end in FIG. 8, protrudes frontward relatively to the other side edge, which is an upper end in FIG. 8. The arm portion 31*b* has a plurality of convex portions 34 each protruding downwardly beyond a bottom surface of the other parts of the arm portion 31*b*. The bracket body 31 is formed with a plurality of screw holes 31*d* each penetrating therethrough in a thickness direction thereof: the base portion 31*a* is formed with one screw hole 31*d*; the distal end of the arm portion 31*b* is formed with two screw holes 31*d*; and each of the convex portions 34 is formed with one screw hole 31*d*, in this embodiment.

The first bracket 32, which is also a strip-shaped metal member, has a generally L shape, in this embodiment. Specifically, the first bracket 32 has a connection portion 32*a* to be connected to the arm portion 31*b* of the bracket body 31, and a latch support portion 32*b* extending from the connection portion 32*a* perpendicularly to the connection portion 32*a*; the after-mentioned latch member 19 is fixed to the latch support portion 32*b*. The connection portion 32*a* has a shape joinable to one of opposite side surfaces of the arm portion 31*b* of the bracket body 31, and the latch support portion 32*b* continues to the connection portion 32*a* with an inclination corresponding to that of the inclined region 31*c* of the arm portion 31*b*. The connection portion 32*a* has bolt-insertion holes 32*c* at respective positions corresponding to the screw holes 31*d* formed in the arm portion 31*b*. Into each of the bolt-insertion holes 32*c* is inserted a bolt B, which is screwed into corresponding one of the screw holes 31*d*, thus fastening the first bracket 32 to the bracket body 31.

The latch member 19 is provided to hold the side cover 15 in the closed position in cooperation with the lockable member 20, specifically adapted to latch the lockable member 20 when the side cover 15 is in the closed position. As shown in FIG. 7, etc., the latch member 19 has a knob 19*a* for manual swinging operation thereof and a rectangular ring 19*b* pivotably supported by the knob 19*a*. Between the latch member 19 and the lock member 20, there is set a relative positional relationship so as to allow the side cover 15 to be held in the closed state by hooking the hook 20*a* of the lockable member 20 to the ring 19*b* and manually swinging the knob 19*a*, when the side cover 15 is in the closed state.

The second bracket 33, which is a flat plate-like metal member having a generally T shape, has a rectangular-shaped mounting portion 33*a* and a pair of protruding portions 33*b* and 33*b* each protruding from an upper end of the mounting portion 33*a* in respective opposite directions parallel to a side surface thereof. Each of the protruding portions 33*b* is formed with a bolt insertion hole 33*c* at a position corresponding to that of the screw hole 31*d* of each of the convex portions 34 in the bracket body 31. Into each of the screw holes 33*c* is inserted a bolt B, which is screwed into corresponding one of the screw holes 31*d*, thus fastening the second bracket 33 to the bracket body 31.

The mounting portion 33*a* has opposite side surfaces, one of which is a attachment surface located on the side of the latch support portion 32*b*; the selector valve 36 is attached to the attachment surface. The selector valve 36, which is a device for changing a flow of hydraulic fluid in cooperation with the control valve 14, is able to be manually operated.

As shown in FIGS. 6 and 7, the support bracket 30 supports each of the latch member 19 and the selector valve 36 on the side of the base 21, indirectly on the side of the frame 4, while attached to the base 21. The support bracket 30 has a shape which is set such that, in the above state, the latch member 19 and the latch support portion 32*b* protect the selector valve 36, i.e., each of the latch member 19 and the latch support portion 32*b* is supported at a position closer to the opening 16 than the selector valve 36 and higher than the selector valve 36 (more specifically, a position frontward and obliquely upward of the selector valve 36 and adjacent to the selector valve 36).

Such a relative positional relationship between the latch member 19 and the selector valve 36 enables the latch member 19 to function as a protective member for the selector valve 36, thereby assisting the protection of the selector valve 36. For example, the hydraulic shovel 1 has a possibility of dropping off a rock or the like scooped up during working and the dropped rock or the like may hit against the front end of the side cover 15 from a front and obliquely upper side thereof; however, the latch member 19 in this embodiment, interposed between the front end of the side cover 15 which is highly likely to be hit by the rock or the like and the selector valve 36, can prevent the side cover 15 from large deformation, thus suppressing shock acting on the selector valve 36. In addition, each of the latch member 19 and the latch support portion 32*b*, being oriented obliquely upwardly so as to face the side cover 15 close thereto, can reliably receive the deformed side cover 15 even if the side cover 15 is deformed.

Although the shock applied to the latch member 19 is transmitted to the support bracket 30, the support bracket 30, which is attached to the base 21 fixed to the frame 4, can stably receive the shock even if it is relatively strong. Although the support bracket 30 is also supported by the hydraulic fluid tank 13 through the base 21, the shock-absorbing member 25 interposed between the hydraulic fluid tank 13 and the base 21 can block the transmission of the shock to the hydraulic fluid tank 13, thereby preventing the hydraulic fluid tank 13 from being damaged due to the contact with the latch member 19, etc.

Figure 10:
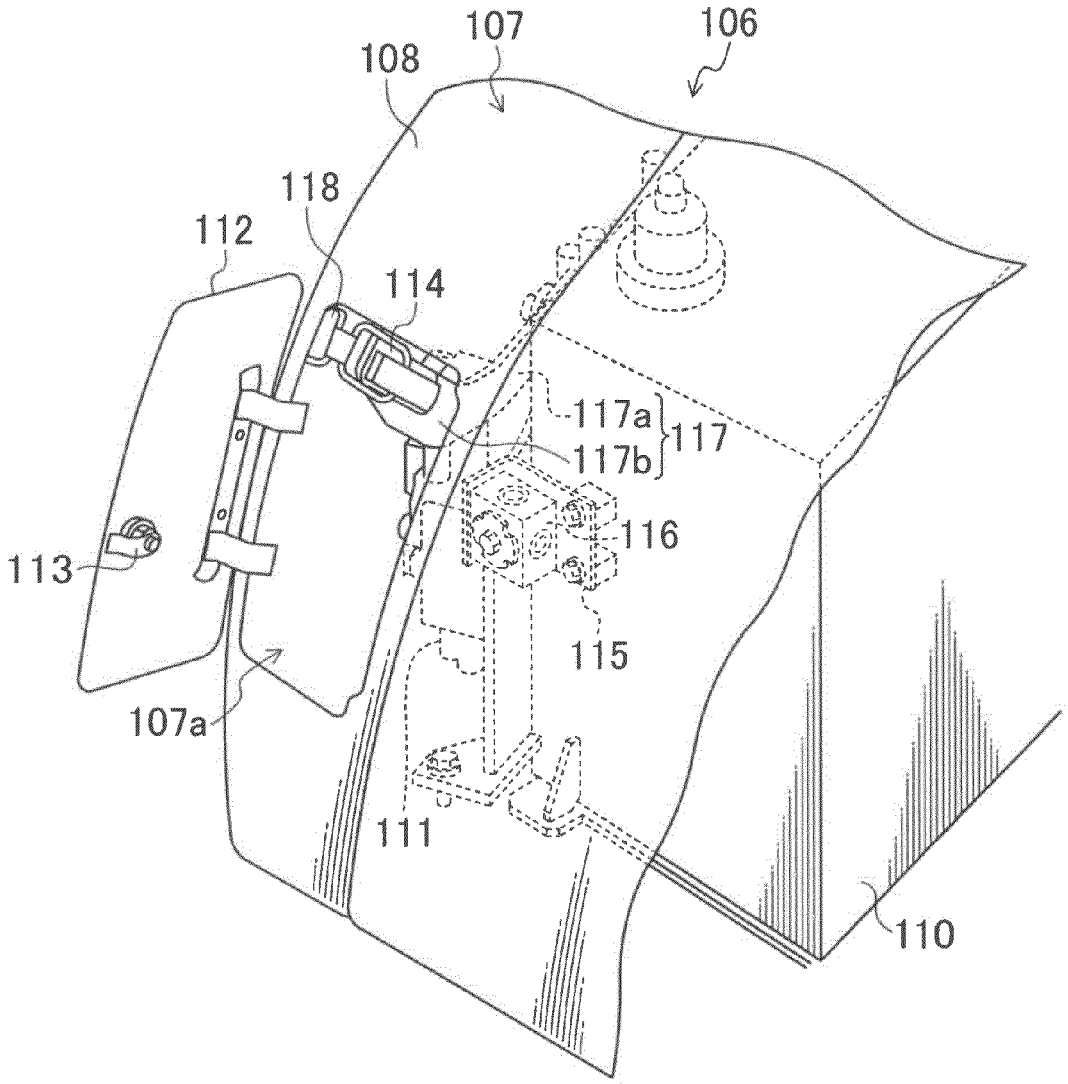
FIG. 10 is a fragmentary perspective view of the hydraulic shovel in FIG. 9.
Figure 11:
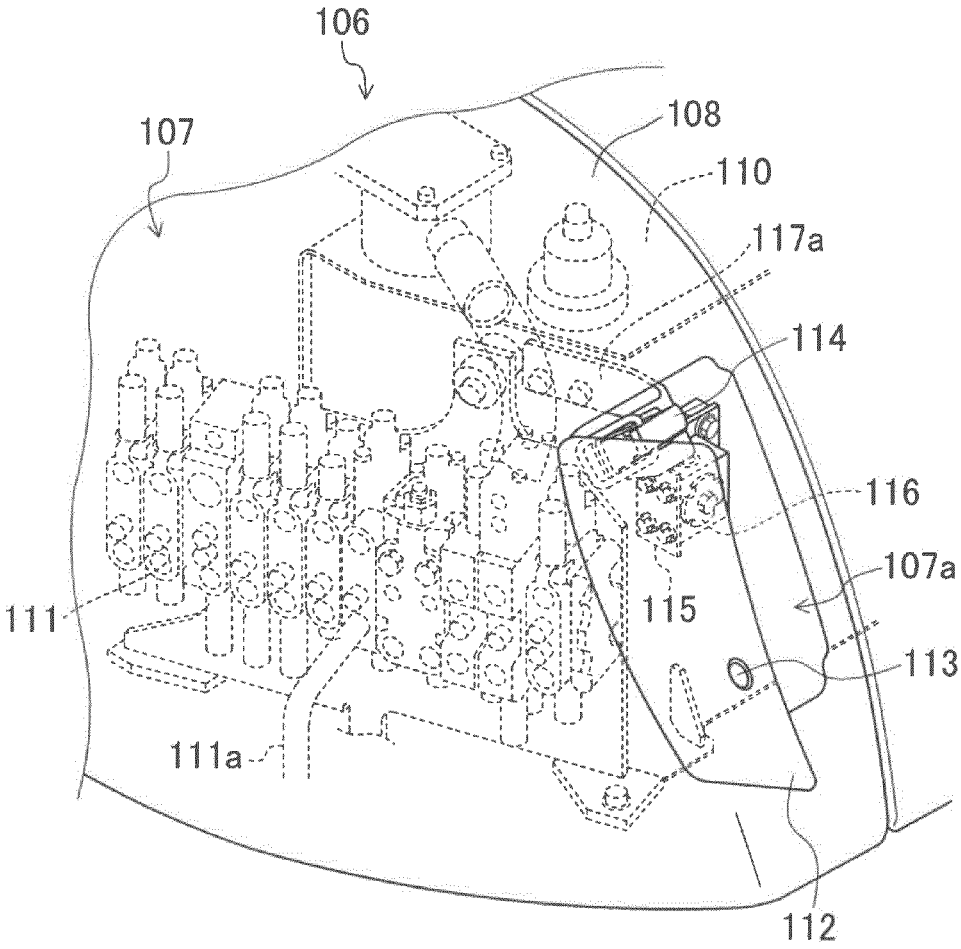
FIG. 11 is a fragmentary perspective view of the hydraulic shovel in FIG. 9.
Figure 12:
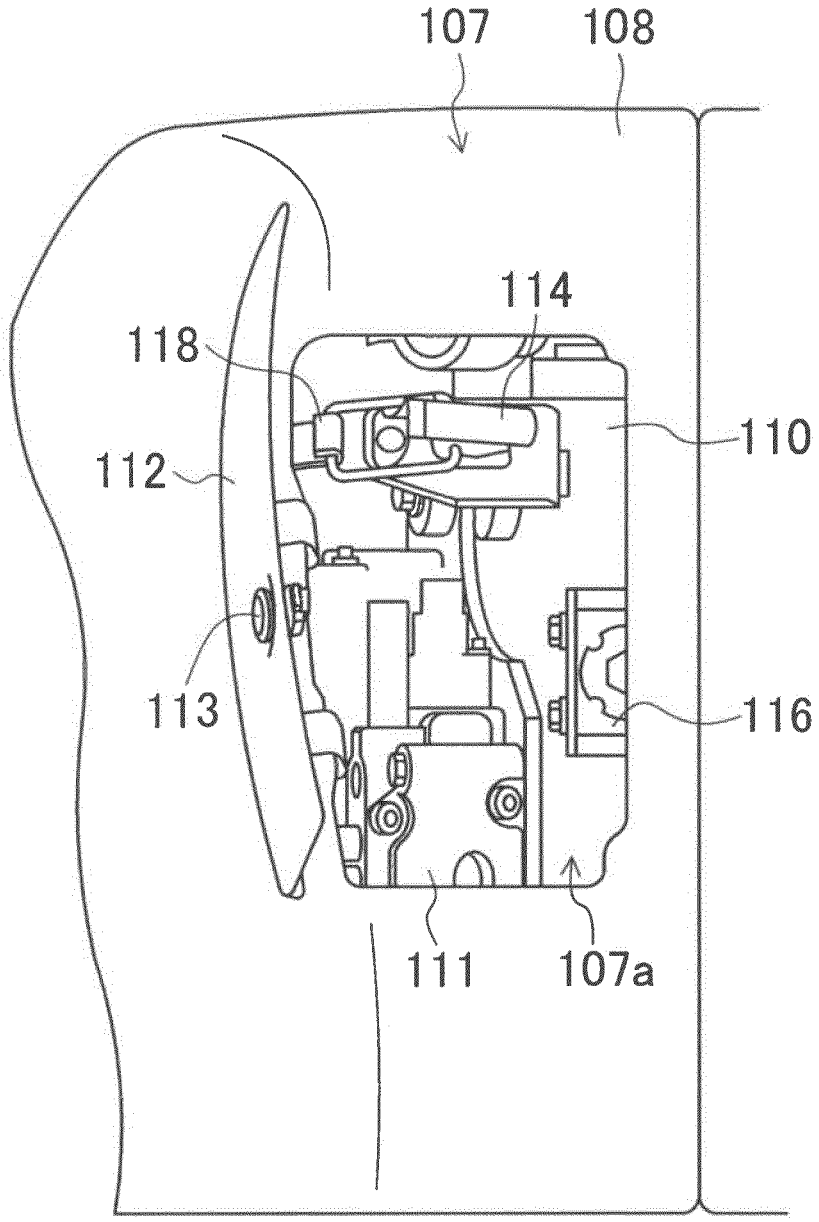
FIG. 12 is a fragmentary front view of the hydraulic shovel in FIG. 9.

For example, the latch member 114 and the selector valve 116 illustrated in FIGS. 10 to 12 as a reference example, being supported by the hydraulic fluid tank 110 through respective ones of the brackets 115 and 117, could allow an external force applied to the latch member 114 and the selector valve 116 to give damage to the hydraulic fluid tank 110. Moreover, the latch bracket 117, if deformed, would prevent the latch member 114 and the lockable member 118 from their engagement with each other, thus preventing them from holding the side cover 107 in the closed state. This makes it necessary to replace the latch bracket 117; however, the latch bracket 117, whose arm portion 117*a* is located at a fairly inward position, cannot be easily displaced.

On the other hand, also in the embodiment, a deformation of the latch member 19 or the first bracket 32 supporting the latch member 19 prevents the latch member 19 and the lockable member 20 from their engagement with each other, to thereby prevent the side cover 15 from closure; however, the first bracket 32, which is detachable from the bracket body 31, allows the repair to be performed by only the replacement of the first bracket 32, without that of the entire support bracket 30. In addition, since the position where the bracket body 31 and the first bracket 32 are fastened to each other is in the distal end of the arm portion 31*b* of the bracket body 31, i.e., one end of the bracket body 31 closer to the opening 16, the operation for disengaging the fastening can be easily performed.

Besides, in this embodiment, as shown in FIG. 4, the opening 16 is located frontward of and adjacent to each of the latch member 19 and the selector valve 36, and the latch member 19 and the selector valve 36 are arranged so as to be within a peripheral edge of the opening 16 and offset vertically in non-overlapping relation with each other, when viewed from a front side of the opening 16. This facilitates the manual swinging operations of the knob 19*a* and manual adjustment operation of the selector valve 36 through the opening 16.

Furthermore, since the support bracket 30 supporting the selector valve 36 in this embodiment is attached to the base 21 supporting the control valve 14, the support bracket 30, the control valve 14 and associated components such as pipes can be pre-assembled to the base 21, before mounting the base 21 to the frame 4, for production of the working machine 1. Therefore, there is no requirement of the operation of assembling the selector valve 36 and connecting the pipes and others following the assembly of the hydraulic fluid tank 13 and the control valve 14 to the frame 4; this results in simplified assembly operation and enhanced productivity.

The working machine according to the present invention is not limited to the above embodiment but may include, for example, the following modifications.

The member to which the support bracket 30 is fixed is not limited to the base 21. The support bracket 30 may, for example, be directly connected to the frame 4 or be connected to the frame 4 through a member different from the base 21. The support bracket 30 may be formed of a single member in its entirety.

While both of the first bracket 32 and the second bracket 33 are detachably connected to the bracket body 31 of the support bracket 30 in the above embodiment, the bracket body 31 and the second bracket 33, which is the selector valve-retaining bracket, may be integrally formed. Also in this case, the damaged or deformed first bracket 32 can be detached from the bracket body 31 to be replaced itself only, as long as the first bracket 32 (as the latch member-retaining bracket) is detachably connected to the bracket body 31.

The specific structure for locking the lockable member 20 by the latch member 19 is not also limited to the structure in the above embodiment; various conventional locking mechanisms may be employed as the engagement means.

The present invention is not limited to the hydraulic shovel 1 in the above embodiment, but can be also applied to any other suitable working machine, such as a crane.

As described above, the present invention provides a working machine, which comprises a cover member for covering an equipment room and a selector valve provided inside the equipment room, having a capability to effectively protect the selector valve even if the cover member is hit by a rock or the like, while allowing the selector valve to be easily operated from outside of the cover member. Specifically, provided is a working machine comprising the following elements: a frame; a working implement supported at a front end of the frame in a vertically swingable manner; a cover member which has a cover-member body adapted to cover a side equipment room located on the frame in laterally adjacent relation to the working implement, from at least front and lateral sides thereof, the cover-member body being formed with an opening, a lid member attached to the cover-member body to selectively open and close the opening, a lockable member attached to an inner side of the cover-member body at a position adjacent to the opening, and a hinge portion which interconnects between the frame and a rear end of the cover-member body and supports the cover-member body in an openable/closable manner; a latch member disposed inside the side equipment room and adjacent to the opening and adapted to hold the cover member in a closed state in cooperation with the lockable member; a selector valve disposed adjacent to the opening and adapted to be manually operable;

and a support bracket which extends from an inward side of the side equipment room toward the opening and supports the latch member and the selector valve on a side of the frame. The support bracket has a selector valve-retaining portion which supports the selector valve, and a latch member-retaining portion which retains the latch member at a position closer to the opening than the selector valve and higher than the selector valve.

It should be noted that the present invention includes not only an embodiment where the support bracket which "supports the latch member and the selector valve on the side of the frame" is directly connected to the frame, but also an embodiment where the support bracket is connected to another member fixed to the frame so as to be indirectly connected to the frame through the member.

In the working machine of the present invention, the support bracket retains the latch member at a position closer to the opening than the selector valve and higher than the selector valve, thereby achieving the protection of the selector valve by utilization of the latch member. Specifically, while the cover member has a portion which is located closer to the opening than the selector valve and higher than the opening and therefore may be deformed by an accidental external force, the above support bracket enables the latch member interposed between the region of the cover member and the selector valve to prevent the cover member from so large deformation as to influence the selector valve.

The latch member and the selector valve are preferably so arranged as to be within a peripheral edge of the opening and in non-overlapping relation with each other, when viewed from a front side of the opening. This arrangement allows the latch member and the selector valve to be easily operated, thus enhancing working performance.

The support bracket preferably has a bracket body connected to a member on a side of the frame at a position inside the side equipment room, and a latch member-retaining bracket which includes the latch member-retaining portion and detachably connected to the bracket body. The member to which the bracket body is connected may be a member which is fixed to the frame, or may be the frame itself. The support bracket allows its latch member-retaining bracket to be separately replaced; this makes it possible to perform a repair by replacing only the latch member-retaining bracket when there occurs a trouble of the latch member or the latch member-retaining portion, for example, due to an external force applied to the cover member.

The above support bracket may further have a selector valve-retaining bracket including the selector valve-retaining portion and detachably connected to the bracket body separately from the latch member-retaining bracket. In this case, it is preferable that the latch member-retaining bracket is detachably connected to an upper region of the distal end of the bracket body and the selector valve-retaining bracket is detachably connected to a lower region of the distal end of the bracket body. This makes it possible to connect both of the latch member-retaining bracket and the selector valve-retaining bracket to the bracket body while allowing the latch member to protect the selector valve in the above manner.

The support bracket may be directly attached to the frame, as well as may be indirectly connected to the frame through an additional member. For example, the working machine of the present invention may further comprise a control valve provided inside the side equipment room and located adjacent to the opening, and a base provided on the frame to support the control valve, the support bracket connected to the base. In this working machine, the base fixed to the frame can stably receive even a large shock applied to the latch member to be transmitted to the support bracket.

For example, in the case of the working machine further comprising a hydraulic fluid tank provided on the frame at a position inside the side equipment room to have a side surface facing the opening, the base is preferably a plate-shaped body and provided to stand on the frame along the side surface of the hydraulic fluid tank, having an upper end connected to the hydraulic fluid tank, the support bracket connected to the upper end of the base. This support bracket, being connected to the upper end of the base connected to both of the frame and the hydraulic fluid tank, can be supported with high rigidity. In other words, the rigidity for supporting the support bracket can be enhanced by effective utilization of the hydraulic fluid tank.

In this case, the working machine more preferably comprises a shock-absorbing member interposed between the upper end of the base and the hydraulic fluid tank to suppress shock transmission from the support bracket to the hydraulic fluid tank. This makes it possible to prevent shock applied to the support bracket from being transmitted to the hydraulic fluid tank, with a simple structure, while allowing the hydraulic fluid tank to be used for supporting the support bracket.

This application is based on Japanese patent application serial no. 2010-082374, filed in Japan Patent Office on Mar. 31, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A working machine comprising:

a frame;

a working implement supported at a front end of the frame in a vertically swingable manner;

a cover member which has a cover-member body adapted to cover a side equipment room located on the frame in laterally adjacent relation to the working implement, from at least front and lateral sides thereof, the cover-member body being formed with an opening, a lid member attached to the cover-member body to selectively open and close the opening, a lockable member attached to an inner side of the cover-member body at a position adjacent to the opening, and a hinge portion which interconnects the frame and a rear end of the cover-member body and supports the cover-member body in an openable/closable manner;

a latch member disposed inside the side equipment room and adjacent to the opening and adapted to hold the cover member in a closed state in cooperation with the lockable member;

a selector valve disposed adjacent to the opening and adapted to be manually operable; and a support bracket which extends from an inward side of the side equipment room toward the opening and supports the latch member and the selector valve on a side of the frame, the support bracket having a selector valve-retaining portion which retains the selector valve, a latch member-retaining portion which retains the latch member and a base portion which is connected to the frame or connected to another member fixed to the frame, the latch member-retaining portion retaining the latch member at a position closer to the opening than the selector valve supported by the selector valve-retaining portion and higher than the selector valve in a state that the base portion is connected to the frame or connected to another member.

2. The working machine as defined in claim 1, wherein the latch member and the selector valve are arranged so as to be within a peripheral edge of the opening and in non-overlapping relation with each other, when viewed from a front side of the opening.

3. The working machine as defined in claim 1, wherein the support bracket has a bracket body connected to a member on a side of the frame at a position inside the side equipment room, and a latch member-retaining bracket including the latch member-retaining portion and detachably connected to the bracket body, the bracket body having a distal end oriented toward the opening, the latch member-retaining bracket being connected to the distal end of the bracket body.

4. The working machine as defined in claim 3, wherein the support bracket further has a selector valve-retaining bracket including the selector valve-retaining portion and detachably connected to the bracket body separately from the latch member-retaining bracket, the latch member-retaining bracket being detachably connected to an upper region of the distal end of the bracket body, the selector valve-retaining bracket being detachably connected to a lower region of the distal end of the bracket body.

5. The working machine as defined in claim 1, which further comprises a control valve provided inside the side equipment room and located adjacent to the opening, and a base provided on the frame at a position inside the side equipment room to support the control valve, the support bracket being connected to the base.

6. The working machine as defined in claim 5, which further comprises a hydraulic fluid tank provided on the frame at a position inside the side equipment room to have a side surface facing the opening, and wherein the base is a plate-shaped body and provided to stand on the frame along the side surface of the hydraulic fluid tank, the base having an upper end connected to the hydraulic fluid tank, the support bracket being connected to the upper end of the base.

7. The working machine as defined in claim 6, which further comprises a shock-absorbing member interposed between the upper end of the base and the hydraulic fluid tank to suppress shock transmission from the support bracket to the hydraulic fluid tank.

* * * * *